US012188694B2

(12) United States Patent
Mercer et al.

(10) Patent No.: US 12,188,694 B2
(45) Date of Patent: Jan. 7, 2025

(54) CONDENSATE BLOCK FOR V-COIL HEAT EXCHANGER

(71) Applicant: Carrier Corporation, Palm Beach Gardens, FL (US)

(72) Inventors: Kevin Mercer, Danville, IN (US); Jorge A. Solis, Carmel, IN (US); Elnaz Norouzi, Indianapolis, IN (US); Sara Shayan Amin, Carmel, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 339 days.

(21) Appl. No.: 17/646,772

(22) Filed: Jan. 3, 2022

(65) Prior Publication Data

US 2022/0235980 A1 Jul. 28, 2022

Related U.S. Application Data

(60) Provisional application No. 63/200,838, filed on Mar. 31, 2021, provisional application No. 63/199,768, filed on Jan. 23, 2021.

(51) Int. Cl.
*F25B 39/02* (2006.01)

(52) U.S. Cl.
CPC ..... *F25B 39/02* (2013.01)

(58) Field of Classification Search
CPC ..... F25B 39/02; F24F 13/222; F24F 13/22; F28D 1/0426; F28F 17/005; F28F 9/013; F25D 21/14
See application file for complete search history.

(56) References Cited

U.S. PATENT DOCUMENTS

| | | | | |
|---|---|---|---|---|
| 5,669,230 | A * | 9/1997 | Bruce | F24F 1/027 62/288 |
| 2009/0249812 | A1* | 10/2009 | Timbs | F24F 13/222 62/56 |
| 2018/0340706 | A1* | 11/2018 | Amick | F24F 13/20 |
| 2019/0113247 | A1* | 4/2019 | Lepoudre | H05K 7/20827 |
| 2020/0330923 | A1* | 10/2020 | Johnson | C02F 1/448 |

* cited by examiner

*Primary Examiner* — Len Tran
*Assistant Examiner* — Kamran Tavakoldavani
(74) *Attorney, Agent, or Firm* — Souad Hakim

(57) ABSTRACT

A condensate block for a vertically mounted v-coil heat exchanger (which may function as an evaporator), and an evaporator assembly for a heating, ventilation, and air conditioning (HVAC) system incorporating the condensate block are provided. The condensate block includes a body. The body is made of a malleable, flame-resistant material. The body defines at least one upward facing surface and opposing outward facing surfaces. The opposing outward facing surfaces are configured at an apex angle that is complimentary to (e.g., equal to, or greater than) a v-coil bend angle defined by the v-coil heat exchanger.

18 Claims, 9 Drawing Sheets

CONDENSATE BLOCK FOR V-COIL HEAT EXCHANGER

CROSS REFERENCE TO A RELATED APPLICATION

The application claims the benefit of U.S. Provisional Application No. 63/199,768 filed Jan. 23, 2021 and U.S. Provisional Application No. 63/200,838 filed Mar. 31, 2021, the contents of which are hereby incorporated in their entirety.

BACKGROUND

The disclosed embodiments relate to heating and cooling systems and more specifically to a condensate block for a heat exchanger (e.g., an evaporator coil of an HVAC system) that is configured in a v-shaped arrangement (v-coil).

An evaporator coil is commonly used within HVAC systems. In certain instances, the evaporator coil may be a microchannel heat exchanger (MCHX), which may be configured in a v-coil arrangement. The evaporator coil may be mounted vertically in a housing (e.g., of a furnace, etc.), which may be connected in line with the ductwork of, for example, a home. The evaporator coil is designed to become cold when the unit operates. When the system is on, air flows through the coil and the cold air is distributed throughout the home. This air is commonly forced through the coil using a blower (which may be referred to as a fan assembly). This HVAC system may either be in an upflow configuration or in a downflow configuration. When in upflow configuration the blower forces air upwards through the housing toward the bottom of the 'V' (when the heat exchanger is configured in a v-shaped arrangement). When in downflow configuration the blower forces air downwards through the housing toward the open, top portion of the 'V' (when the heat exchanger is configured in a v-shaped arrangement). As can be assumed, when the air is cooled moisture in the air drops out and forms condensate. This condensate is commonly collected using a condensate receptor, which is commonly placed at the bottom of the 'v-coil.' Due to the open nature of the bottom of the 'V' (i.e., to allow the heat exchanger to be bent in the v-coil arrangement) and the open nature of the condensate receptor, there is potential that condensate may blow through the HVAC system and into the ductwork when in a downflow configuration.

Accordingly, there remains a need for an invention that mitigates the potential of condensate blowing through the HVAC system and into the ductwork when the HVAC system is in a downflow configuration.

BRIEF DESCRIPTION

According to one embodiment, an evaporator assembly for a heating, ventilation, and air conditioning (HVAC) system is provided. The evaporator assembly including a housing, a fan assembly disposed within the housing, a v-coil heat exchanger mounted within the housing, downstream of the fan assembly, and a condensate block disposed adjacent to the v-coil heat exchanger. The v-coil heat exchanger defines a v-coil bend angle. The condensate block has a body made of a malleable, flame-resistant material. The body defining at least one upward facing surface and opposing outward facing surfaces. The opposing outward facing surfaces are configured at an apex angle, the apex angle being complimentary to the v-coil bend angle.

In accordance with additional or alternative embodiments, the v-coil bend angle is defined by a bend section of the v-coil heat exchanger, the bend section being disposed between a first leg and a second leg of the v-coil heat exchanger, each of the first leg and the second leg being closer to the fan assembly than the bend section.

In accordance with additional or alternative embodiments, the first leg and the second leg each include one or more fins disposed between heat exchange tube segments, and the bend section is devoid of any fins.

In accordance with additional or alternative embodiments, the upward facing surface of the condensate block spans between the fins of first leg and the fins of the second leg.

In accordance with additional or alternative embodiments, the apex angle is greater than the v-coil bend angle.

In accordance with additional or alternative embodiments, the apex angle is at least 5° greater than the v-coil bend angle.

In accordance with additional or alternative embodiments, the evaporator assembly further includes a condensate receptor positioned downstream of the bend section, the condensate receptor configured to receive the bend section of the v-coil heat exchanger.

In accordance with additional or alternative embodiments, the condensate receptor includes a first channel with a length defined between a first end of the first channel and a second end of the first channel, the condensate block including a length defined between a first end of the condensate block and a second end of the condensate block, the length of the condensate block being complimentary to the length of the first channel.

In accordance with additional or alternative embodiments, the length of the condensate block is at least 90% of the length of the first channel.

In accordance with additional or alternative embodiments, the malleable, flame-resistant material comprises at least one of: a non-porous foam, and a malleable plastic.

In accordance with additional or alternative embodiments, the malleable, flame-resistant material is non-permeable to water.

According to another aspect of the disclosure, a condensate block for a vertically mounted v-coil heat exchanger is provided. The condensate block including a body made of a malleable, flame-resistant material. The body defining at least one upward facing surface and opposing outward facing surfaces. The outward facing surfaces configured at an apex angle. The apex angle being complimentary to a v-coil bend angle defined by the v-coil heat exchanger.

In accordance with additional or alternative embodiments, the v-coil bend angle is defined by a bend section of the v-coil heat exchanger, the bend section being disposed between a first leg and a second leg of the v-coil heat exchanger, each of the first leg and the second leg being closer to the fan assembly than the bend section.

In accordance with additional or alternative embodiments, the first leg and the second leg each include one or more fins disposed between heat exchange tube segments, the bend section devoid of any fins, the upward facing surface of the condensate block spanning between the fins of first leg and the fins of the second leg.

In accordance with additional or alternative embodiments, the apex angle is greater than the v-coil bend angle.

In accordance with additional or alternative embodiments, the apex angle is at least 5° greater than the v-coil bend angle.

In accordance with additional or alternative embodiments, the bend section is configured to be received by a drain pan, the condensate receptor includes a first channel with a length defined between a first end of the first channel and a second end of the first channel, the condensate block has a length defined between a first end of the condensate block and a second end of the condensate block, the length of the condensate block being complimentary to the length of the first channel.

In accordance with additional or alternative embodiments, the length of the condensate block is at least 90% of the length of the first channel.

In accordance with additional or alternative embodiments, the malleable, flame-resistant material comprises at least one of: a non-porous foam, and a malleable plastic.

In accordance with additional or alternative embodiments, the malleable, flame-resistant material is non-permeable to water.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike.

DETAILED DESCRIPTION

Figure 1:
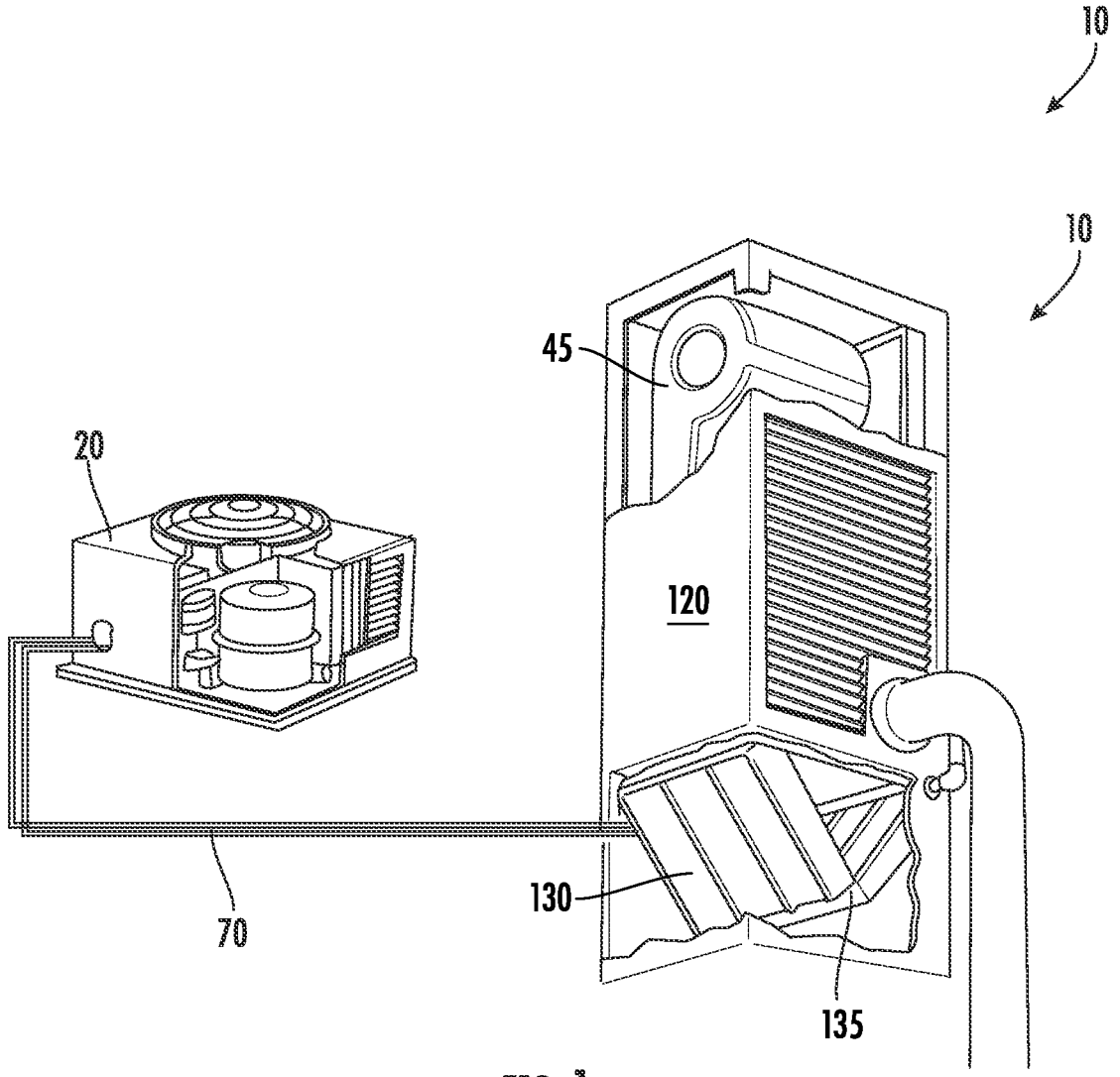
FIG. 1 is a perspective view of an exemplary heating, ventilation, and air conditioning (HVAC) system with an evaporator assembly in downflow configuration in accordance with one aspect of the disclosure.

FIG. 1 illustrates an exemplary heating, ventilation, and air conditioning (HVAC) system 10. As shown, the HVAC system 10 may include a condenser assembly 20 and an evaporator assembly 100 (which may also be referred to as an air handler). The evaporator assembly 100 may include a housing 120 (e.g., made of sheet metal, etc.), a fan assembly 45 disposed within the housing, and a heat exchanger 130, which, as shown, may be configured into a v-shaped arrangement. It should be understood that the terms 'upstream' and 'downstream' are in relationship to the flow of air, which may be directed by the fan assembly 45. For example, the v-coil heat exchanger 130 depicted in FIG. 1 is downstream of the fan assembly 45. It should be appreciated that the v-shaped coil arrangement shown in FIG. 1 may present challenges for effectively managing condensate without the use of a condensate block (described below), due, at least in part, to the downflow configuration. For example, when in downflow configuration the fan assembly may blow condensate out of the condensate receptor and through the HVAC system and into the ductwork if no condensate block is present (which may not be ideal). This is largely due to the open nature of the bottom of the v-coil heat exchanger 130 (to allow the heat exchanger to be bent in the v-coil arrangement) and the open nature of the condensate receptor (to allow the flow and collection of the condensate).

Figure 2B:
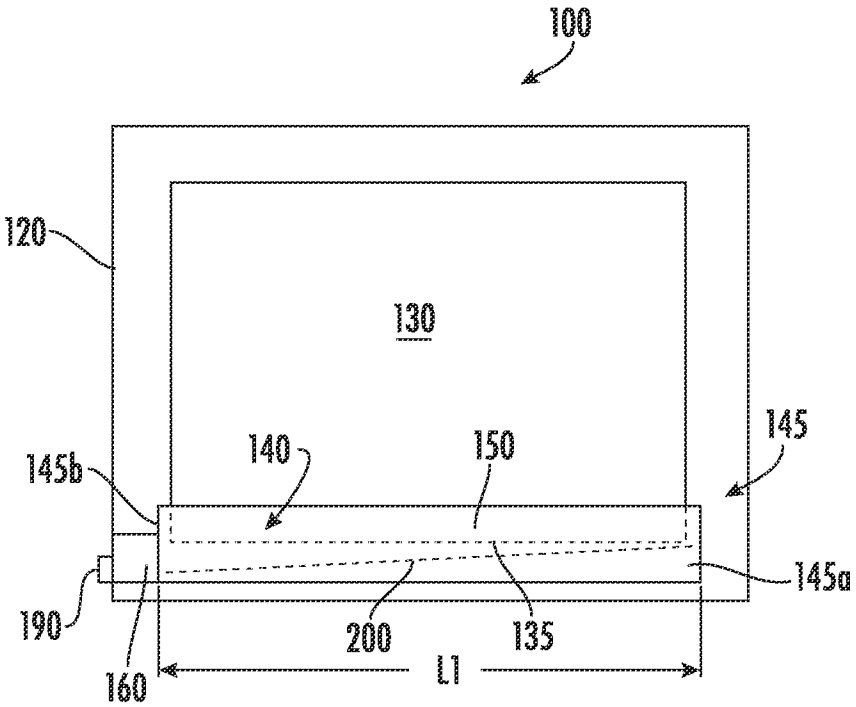
FIG. 2B is a side view of the portion of the evaporator assembly shown in FIG. 2A in accordance with one aspect of the disclosure.
Figure 2A:
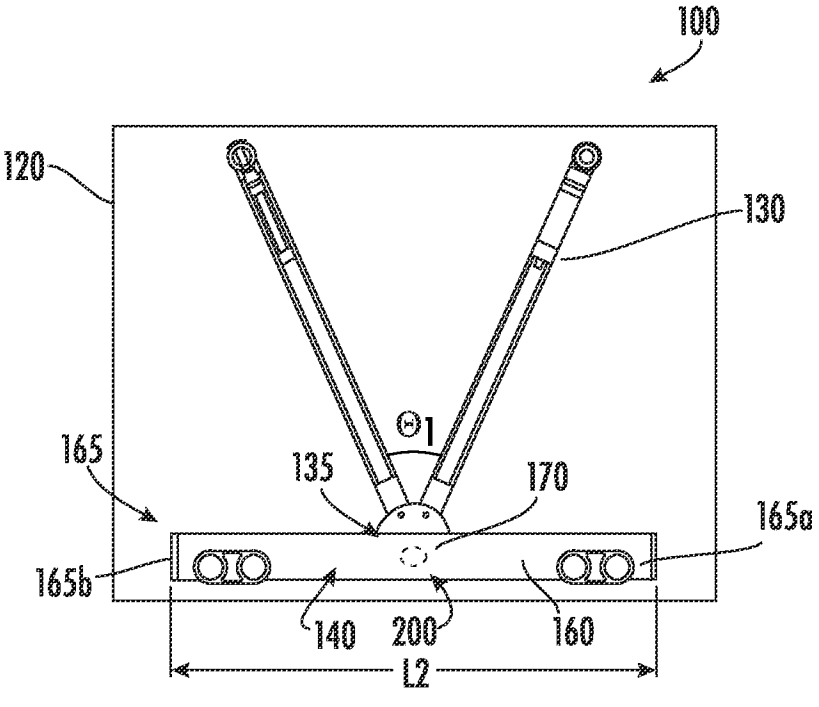
FIG. 2A is a front view of a portion of the evaporator assembly including a heat exchanger in a v-shaped arrangement (v-coil) and a condensate receptor within a housing in accordance with one aspect of the disclosure.
Figure 2C:
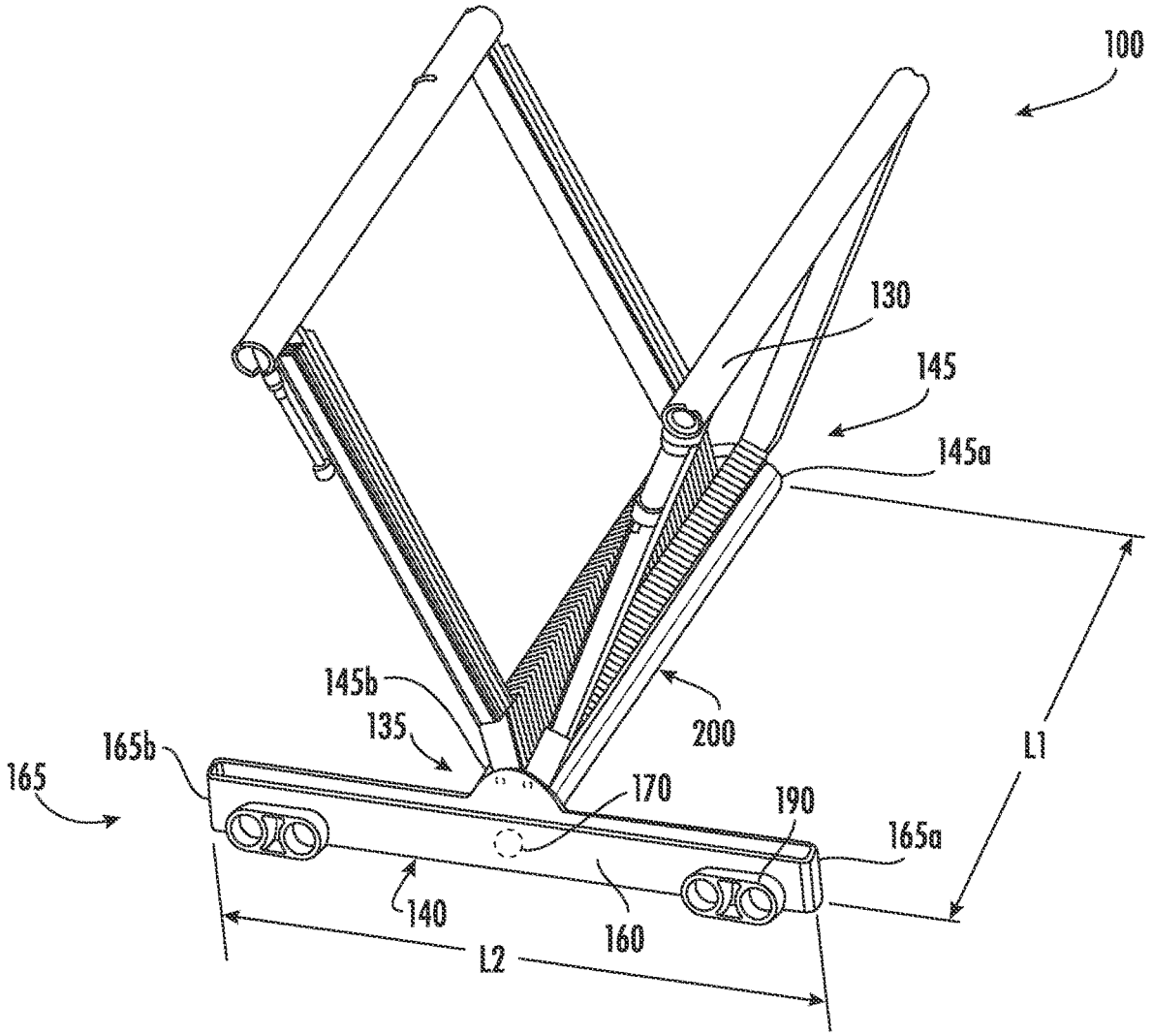
FIG. 2C is a perspective view of the portion of the evaporator assembly shown in FIG. 2A in accordance with one aspect of the disclosure.
Figure 5:
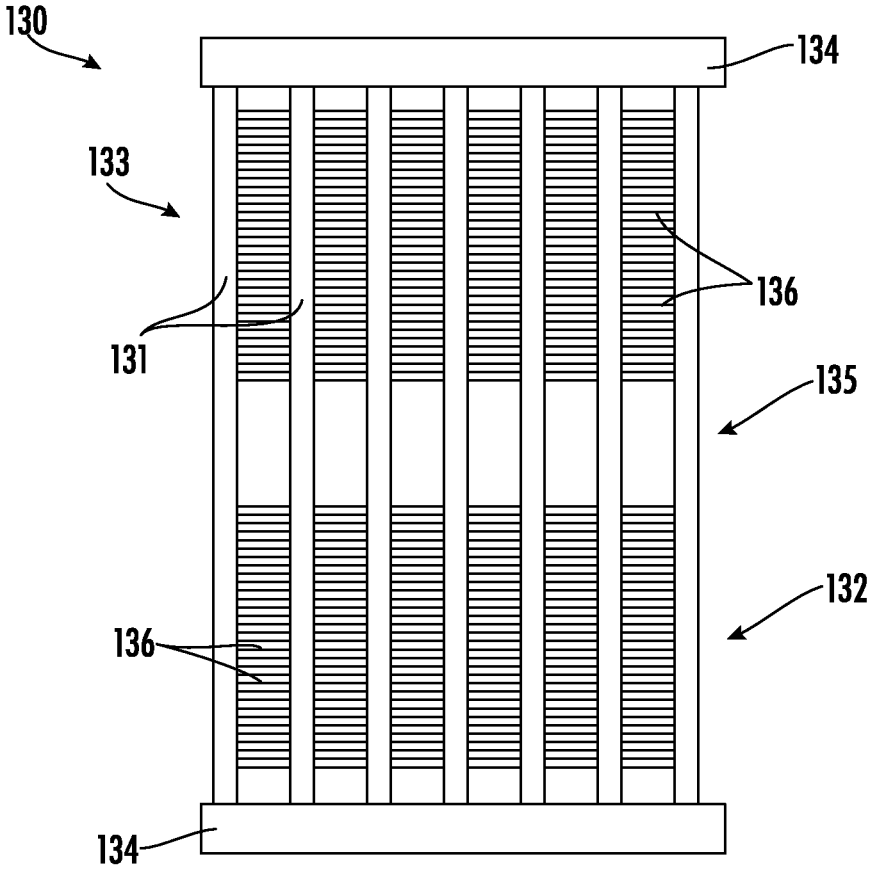
FIG. 5 is a perspective top view of an exemplary heat exchanger in accordance with one aspect of the disclosure.
Figure 6:
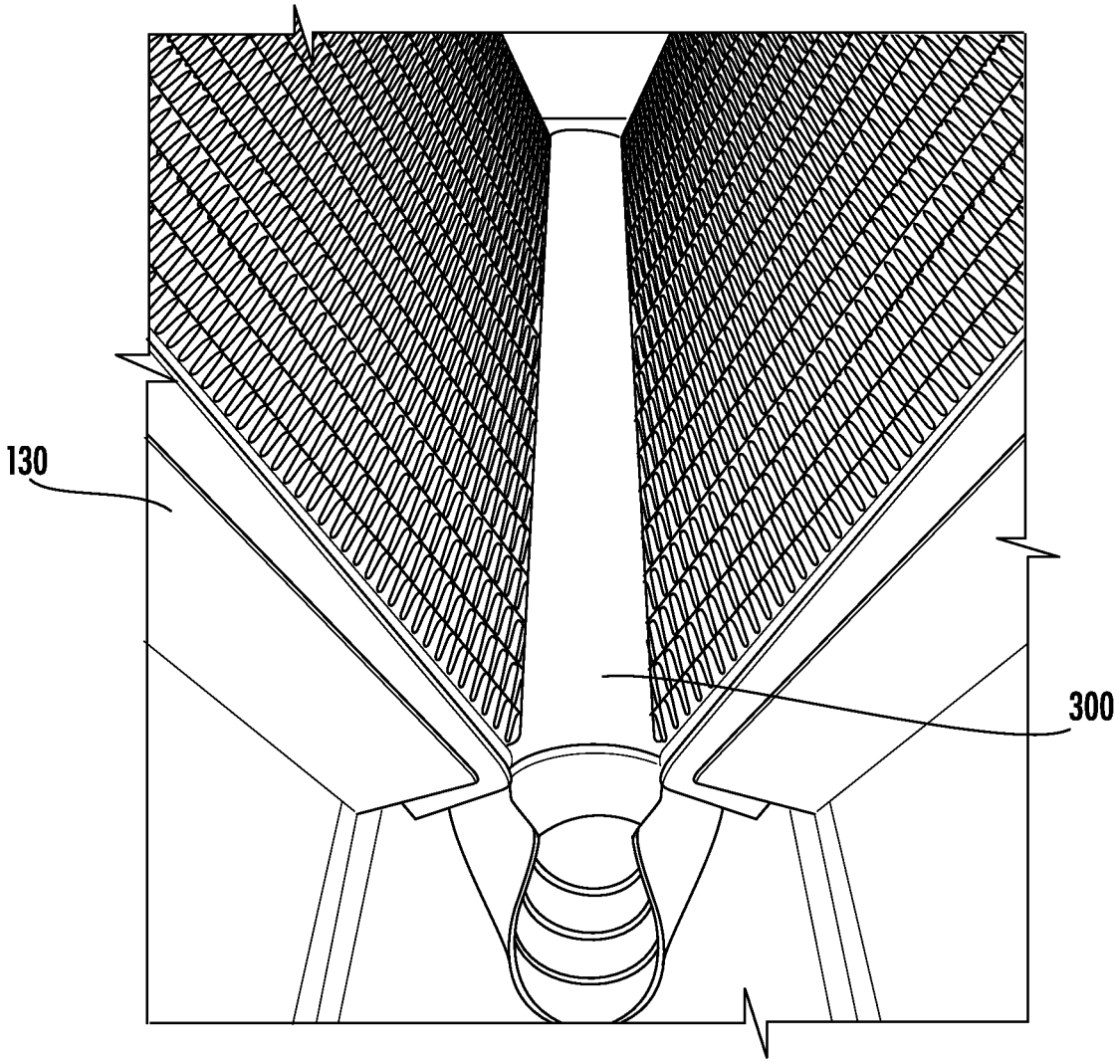
FIG. 6 is a perspective side view of an exemplary condensate block disposed adjacent to a heat exchanger in a v-shaped arrangement (i.e., a v-coil heat exchanger) in accordance with one aspect of the disclosure.

As shown in FIGS. 2A-2C, the evaporator assembly 100 may include a v-coil heat exchanger 130 (which may define a v-coil bend angle $\Theta_1$) vertically mounted within the housing 120. It should be appreciated that the v-coil heat exchanger 130 may be configured from a microchannel heat exchanger or a round tube plate fin constructions in certain instances. As shown, a condensate receptor 140 may be mounted within the housing 120, downstream of the v-coil heat exchanger 130, and may be configured to receive the bend section 135 (shown in FIG. 5) of the v-coil heat exchanger 130. As shown in FIG. 5, the v-coil bend angle $\Theta_1$ may be defined by a bend section 135 of the v-coil heat exchanger 130. For example, the v-coil heat exchanger 130 may be viewed to have a first leg 132 and a second leg 133, each of which may be closer to the fan assembly 45 than the bend section 135 when installed. As mentioned above, the bottom of the v-shaped heat exchanger 130 (i.e., the bend section 135) may be open to allow the heat exchanger 130 to be bent in the v-coil arrangement. Being 'open' may be interpreted to mean that the bend section 135 may be devoid of any fins. As shown in FIG. 5, each of the first leg 132 and the second leg 133 may include one or more fins 136 disposed between heat exchange tube segments 131. As shown in FIG. 6, the condensate block 300 may span between the fins 136 of the first leg 132 and the fins 136 of the second leg 133 when installed.

Figure 3A:
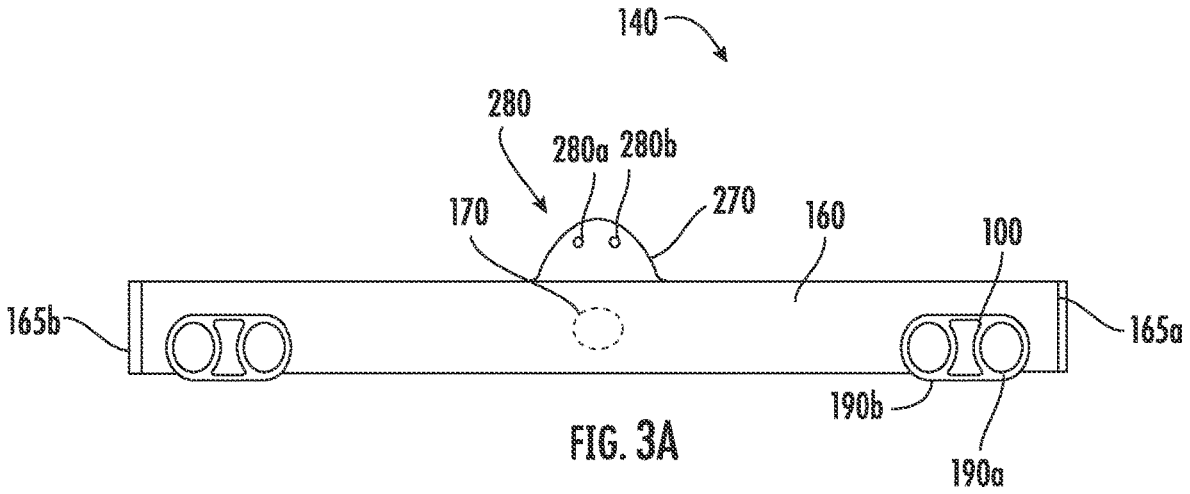
FIG. 3A is a front view of the condensate receptor shown in FIG. 2A in accordance with one aspect of the disclosure.
Figure 3B:
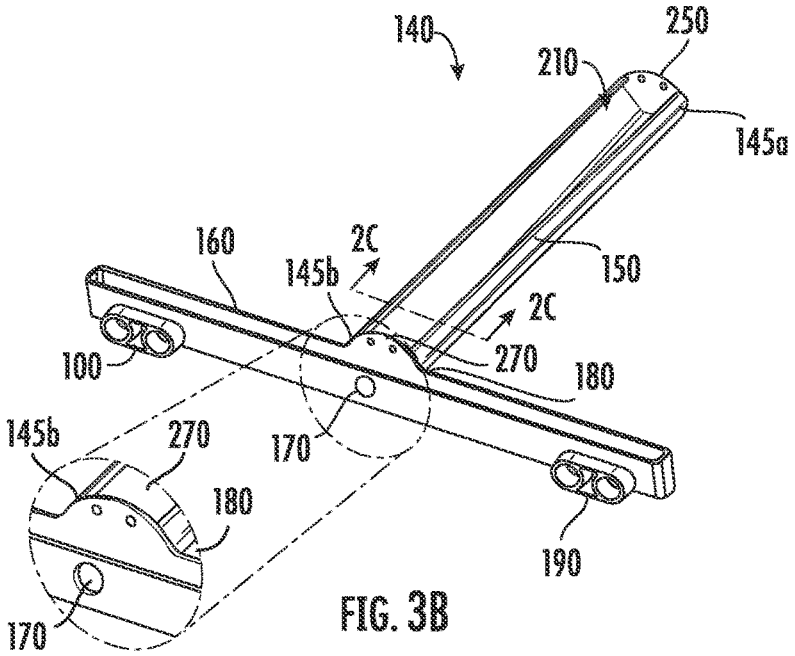
FIG. 3B is a perspective view of the condensate receptor shown in FIG. 2A, the condensate receptor including a first channel and a second channel, in accordance with one aspect of the disclosure.

Turning back to the condensate receptor 140, as shown in FIGS. 2C and 3B, the condensate receptor 140 may include a first channel 150 having a length L1 defined between a first end 145*a* and a second end 145*b* of the first channel 150. It is envisioned that the length L1 of the first channel 150 may be complimentary (i.e., approximately the same length, width, etc.) to the v-coil heat exchanger 130 (to enable the bend section 135 to be received by the first channel 150). As shown, the condensate receptor 140 may include a second channel 160, in certain instances, which may be viewed to have a second length L2 defined between opposing ends 165*a*, 165*b*. The second channel 160 may be perpendicular to the first channel 150. The second channel 160 may include a first orifice 170 illustrated schematically intermediate the second opposing ends 165 for receiving condensate from the first channel 150.

Figure 3C:
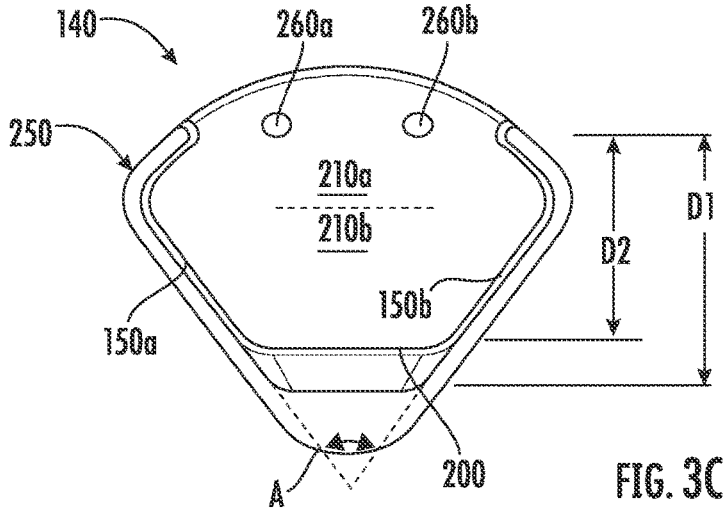
FIG. 3C is a cross-sectional view of the first channel of the condensate receptor shown in FIG. 3B in accordance with one aspect of the disclosure.

Turning to FIGS. 3A-3C, the first orifice 170 may be fluidly connected to one end of the first opposing ends 145*a*, 145*b* and specifically the downstream end 145*b*, at a junction 180 which substantially defines a T-shape. For example the downstream end 145*b* may open into the second channel 160 to allow condensate to flow substantially unobstructed from the first channel 150 to the second channel 160. The second channel 160 may include a fluid drain port 190 at one or both of the second opposing ends 165*a*, 165*b*. The fluid drain port 190 may include a pair of ports 190*a*, 190*b* that may be together disposed at the one or both of the second opposing ends 165*a*, 165*b*. Each port 190 may have a circular profile for condensate drainage therethrough. As can be appreciated providing drain ports at both of the second opposing ends 165*a*, 165*b* may increase an ability to drain condensate from the receptor 140. In addition, the drain ports 190 may be configured to protrude from the housing 120 (FIG. 2B) to enable removing of the condensate from the assembly 100.

In an embodiment the first channel 150 may have a bottom surface 200 (shown in FIG. 2B) that is sloped between the first end 145*a* and the second end 145*b*. From this configuration a first depth D1 of the first channel 150, located at the junction 180, may be deeper than a second depth D2 of the first channel 150 located at the other end of the first channel 150, which may assist with condensate removal.

In an embodiment the first channel 150 may include a first internal cross section 210 referenced in FIG. 3B and illustrated, for example, in FIG. 3C. The cross section 210 may include a top portion 210*a* that is arcuate, for example, semicircular, and a bottom portion 210*b* that is frustoconical. That is, in the bottom portion 210*b*, side surfaces 150*a*, 150*b* of the first channel 150 may converge toward the bottom surface 200 of the first channel 150. A converging angle A between the surfaces 150*a*, 150*b* may be between 50° and 90°, which may be optimized to limit impact on the airflow. Other angle configurations, below 50° and above 90°, are within the scope of the disclosed embodiments so as to optimize performance. It should be appreciated that the shape of the top portion 210*a* of the first internal cross section 210 may be constant between the first opposing ends 145*a*, 145*b* in certain instances.

As mentioned above, the first channel 150 may be configured so as to receive the bend section 135 of the v-coil heat exchanger 130. For example, when installing the v-coil heat exchanger 130, a bend section 135 (which may be viewed as a bottom apex, of the v-coil heat exchanger 130) may be positioned against at least part of the bottom surface 200 of the first channel 150 (FIGS. 2A-2B). This may steady the v-coil heat exchanger 130 during installation and, in addition, the shape of the converging orientation of the side surface 150*a*, 150*b* may provide for vertical (upright) alignment of the v-coil heat exchanger 130 during installation.

In an embodiment the upstream end 145*a* of the first channel 150 includes an upstream end wall 250 (FIG. 3C) having a shape that conforms with the first internal cross section 210. The upstream end wall 250 may include an upstream mounting hole 260, which may be a set of holes 260*a*, 260*b*, configured to mount the receptor 140 to the housing 120. The downstream end 145*b* may include a downstream end wall 270 that is a partial end wall having a shape that conforms with at least the top portion 210*a* of the first internal cross section 210. Below the downstream end wall 270, the first orifice 170 provides for flow into the second channel 160, as indicated, to allow condensate to flow to the second channel 160. The downstream end wall 270 may include a downstream mounting hole 280 (FIG. 3A), which may be another set of holes 280*a*, 280*b*, configured to mount the condensate receptor 140 to the housing 120.

Figure 4:
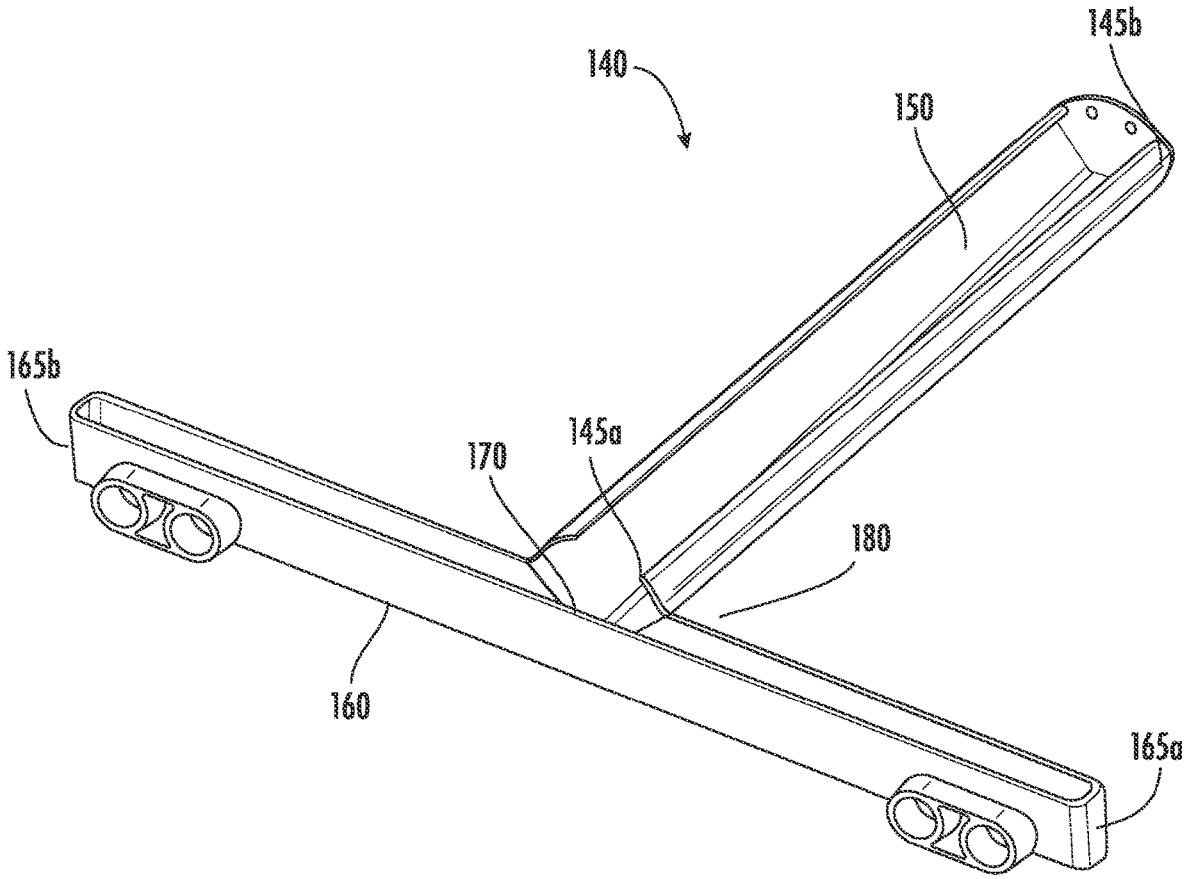
FIG. 4 is a perspective view of the condensate receptor shown in FIG. 2A, illustrating the opposing ends of the first channel and the second channel in accordance with one aspect of the disclosure.

Turning to FIG. 4, in at least one embodiment, the receptor 140 may have each of the features of the embodiment illustrated in FIGS. 3A-3C except for the downstream end wall 270 in the first channel 150. Thus, the first channel 150 and second channel 160 may be opened at a top thereof between the first opposing ends 145, the second opposing ends 165 and at the junction 180. In comparison, as shown in the embodiment of FIGS. 3A-3C, the first channel 150 and second channel 160 may be opened at the top thereof between the first opposing ends 145, the second opposing ends 165, but the downstream end wall 270 may provide an effective cover at the junction 180.

Figure 7:
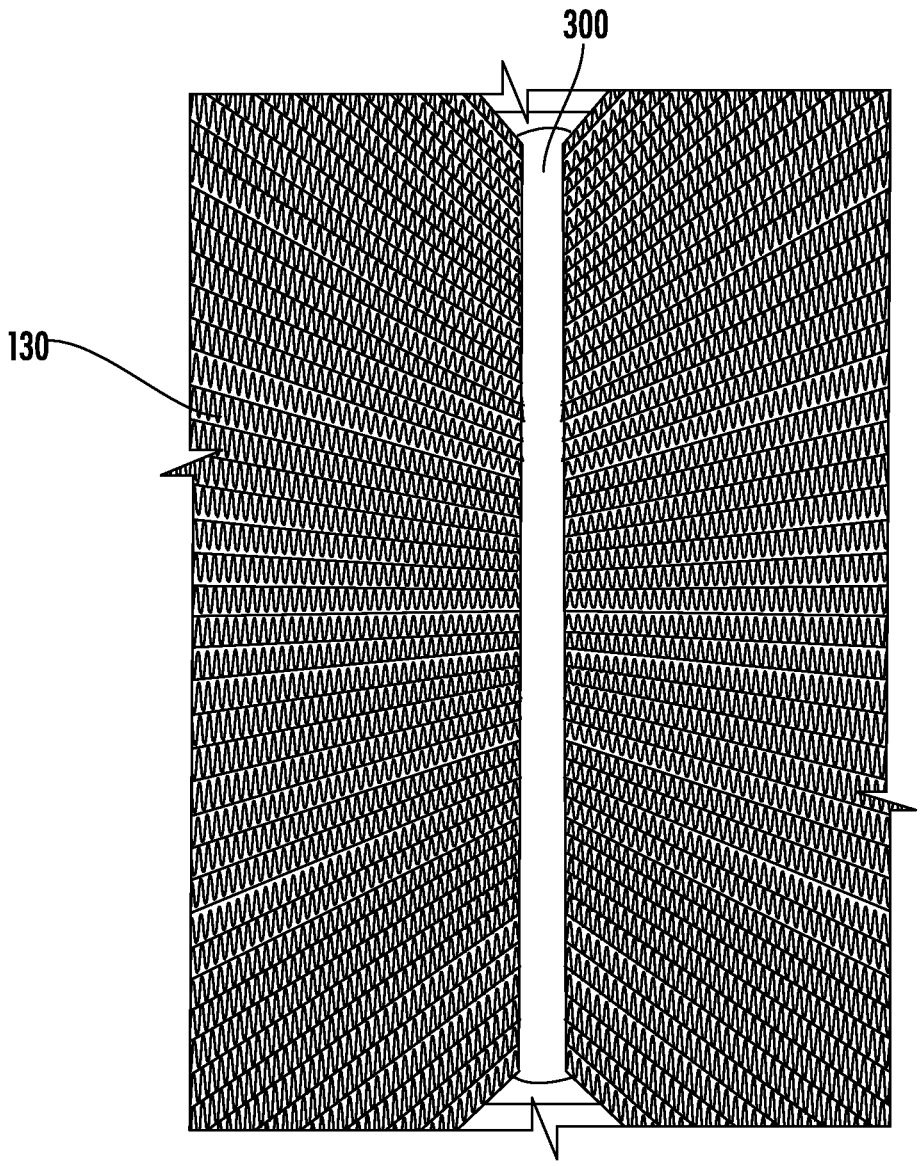
FIG. 7 is a perspective top view of an exemplary condensate block disposed adjacent to a v-coil heat exchanger in accordance with one aspect of the disclosure.
Figure 8:
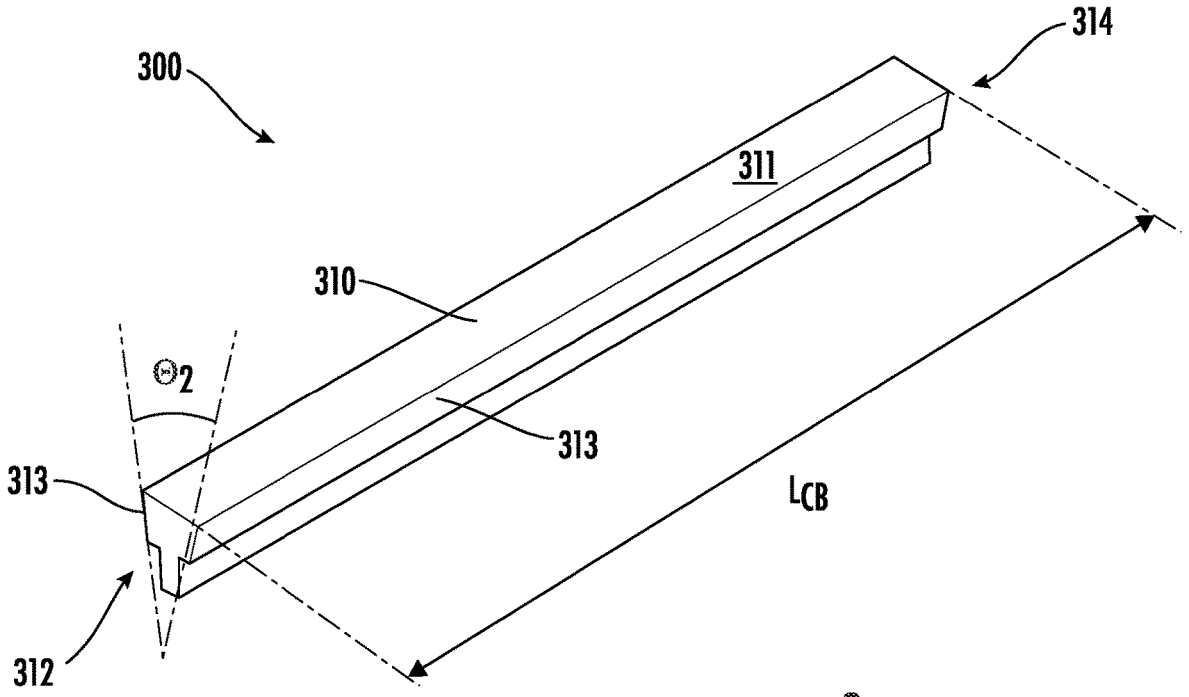
FIG. 8 is a perspective view of an exemplary condensate block in accordance with one aspect of the disclosure.

As mentioned above, due to the open nature of the bend section 131 of the 'V' (i.e., to allow the heat exchanger 130 to be bent in the v-coil arrangement) and the open nature of the condensate receptor 140, there is potential that condensate may blow through the HVAC system 10 and into the ductwork when in a downflow configuration. It should be appreciated that the HVAC system 10 may either be in an upflow configuration or in a downflow configuration. When in upflow configuration the fan assembly 45 forces air upwards through the housing 80 toward the bottom of the 'V' (when the heat exchanger 130 is configured in a v-shaped arrangement). When in downflow configuration the fan assembly 45 forces air downwards through the housing 80 toward the open, top portion of the 'V' (when the heat exchanger 130 is configured in a v-shaped arrangement). In certain instances, the condensate block 300 described herein may only be used when the HVAC system 10 is in a downflow configuration. As shown in FIGS. 6-8, to mitigate the potential of condensate blowing through the HVAC system 10 and into the ductwork when the HVAC system 10 is in a downflow configuration, a condensate block 300 may be disposed adjacent to the v-coil heat exchanger 130 (e.g., directly above the bend section 131). The condensate block 300 may be viewed to include a body 310 made of a malleable, flame-resistant material (e.g., non-porous foam that meets the requirement of UL 1995 or UL 60335-2-40). It should be appreciated that the body 310 may be made of a closed or open cell foam, or a malleable plastic in certain instances. In either case the body 310 may be viewed to be non-permeable to water (e.g., meaning that the body 310 may not absorb condensate). The body 310 may be viewed to define at least one upward facing surface 311 and opposing outward facing surfaces 313. The outward facing surfaces 313 may be configured at an apex angle $\Theta_2$. The apex angle $\Theta_2$ may be complimentary to (e.g., equal to or greater than) the bend angle $\Theta_1$ of the v-coil heat exchanger 130 (i.e., so as to be able to be wedged into the bottom portion (i.e., the bend section 131) of the 'V' to prevent, or at least mitigate, the air from blowing condensate through the HVAC system 10). In certain instances the v-coil bend angle $\Theta_1$ may be between 15° and 50° (as shown in FIG. 2A), and the apex angle $\Theta_2$ may be at least 5° greater (up to 15° greater in certain instances) than the v-coil bend angle $\Theta_1$. For example, the apex angle $\Theta_2$ may be between 20° and 55° in certain instances. It should be appreciated that the condensate block 300 may span the entire bend section 131 to effectively prevent, or at least mitigate, the condensate from being blown through the HVAC system 10 and into the ductwork. As shown in FIGS. 6-8, the length $L_{CB}$ of the condensate block 300 (defined between a first end 312 and second end 314 of the condensate block 300) may be complimentary to the length L1 of the first channel 150. For example the length $L_{CB}$ of the condensate block 300 may be at least 90% to the length L1 of the first channel 150.

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An evaporator assembly for a heating, ventilation, and air conditioning (HVAC) system, the evaporator assembly comprising:

a housing;

a fan assembly disposed within the housing;

a v-coil heat exchanger mounted within the housing, downstream of the fan assembly, the v-coil heat exchanger defining a v-coil bend angle;

a condensate block disposed directly above a bend section of the v-coil heat exchanger, the condensate block comprising a body comprised of a malleable, flame-resistant material, the body defining at least one upward facing surface and opposing outward facing surfaces, the opposing outward facing surfaces configured at an apex angle, the apex angle being complimentary to the v-coil bend angle; and a condensate receptor positioned downstream of the bend section, the condensate receptor configured to receive the bend section of the v-coil heat exchanger, wherein the condensate receptor comprises a first channel comprising a length defined between a first end of the first channel and a second end of the first channel, wherein the condensate block comprises a length defined between a first end of the condensate block and a second end of the condensate block, the length of the condensate block being complimentary to the length of the first channel.

2. The evaporator assembly of claim 1, wherein the v-coil bend angle is defined by the bend section of the v-coil heat exchanger, the bend section being disposed between a first leg and a second leg of the v-coil heat exchanger, each of the first leg and the second leg being closer to the fan assembly than the bend section.

3. The evaporator assembly of claim 2, wherein the first leg and the second leg each comprise one or more fins disposed between heat exchange tube segments, the bend section devoid of any fins.

4. The evaporator assembly of claim 3, wherein the upward facing surface of the condensate block spans between the fins of the first leg and the fins of the second leg.

5. The evaporator assembly of claim 1, wherein the apex angle is greater than the v-coil bend angle.

6. The evaporator assembly of claim 4, wherein the apex angle is at least 5° greater than the v-coil bend angle.

7. The evaporator assembly of claim 1, wherein the length of the condensate block is at least 90% of the length of the first channel.

8. The evaporator assembly of claim 1, wherein the malleable, flame-resistant material comprises at least one of: a non-porous foam, and a malleable plastic.

9. The evaporator assembly of claim 1, wherein the malleable, flame-resistant material is non-permeable to water.

10. A condensate block for a vertically mounted v-coil heat exchanger, the condensate block comprising:

a body comprised of a malleable, flame-resistant material, the body defining at least one upward facing surface and opposing outward facing surfaces, the outward facing surfaces configured at an apex angle, the apex angle being complimentary to a v-coil bend angle defined by the v-coil heat exchanger, wherein the condensate block is disposed directly above a bend section of the v-coil heat exchanger, wherein the bend section is configured to be received by a condensate receptor, the condensate receptor comprising a first channel comprising a length defined between a first end of the first channel and a second end of the first channel, and wherein the condensate block comprises a length defined between a first end of the condensate block and a second end of the condensate block, the length of the condensate block being complimentary to the length of the first channel.

11. The condensate block of claim 10, wherein the v-coil bend angle is defined by the bend section of the v-coil heat exchanger, the bend section being disposed between a first leg and a second leg of the v-coil heat exchanger, each of the first leg and the second leg being closer to a fan assembly than the bend section.

12. The condensate block of claim 11, wherein the first leg and the second leg each comprise one or more fins disposed between heat exchange tube segments, the bend section devoid of any fins, the upward facing surface of the condensate block spanning between the fins of the first leg and the fins of the second leg.

13. The condensate block of claim 10, wherein the apex angle is greater than the v-coil bend angle.

14. The condensate block of claim 13, wherein the apex angle is at least 5° greater than the v-coil bend angle.

15. The condensate block of claim 10, wherein the length of the condensate block is at least 90% of the length of the first channel.

16. The condensate block claim 10, wherein the malleable, flame-resistant material is a non-porous foam.

17. The condensate block of claim 10, wherein the malleable, flame-resistant material is non-permeable to water.

18. An evaporator assembly for a heating, ventilation, and air conditioning (HVAC) system, the evaporator assembly comprising:

a housing;

a fan assembly disposed within the housing;

a v-coil heat exchanger mounted within the housing, downstream of the fan assembly, the v-coil heat exchanger defining a v-coil bend angle;

a condensate block disposed directly above a bend section of the v-coil heat exchanger, the condensate block comprising a body comprised of a malleable, flame-resistant material, the body defining at least one upward facing surface and opposing outward facing surfaces, the opposing outward facing surfaces configured at an apex angle, the apex angle being complimentary to the v-coil bend angle; and a condensate receptor positioned downstream of the bend section, the condensate receptor configured to receive the bend section of the v-coil heat exchanger.

* * * * *